US010000920B2

(12) United States Patent
Palladino

(10) Patent No.: US 10,000,920 B2
(45) Date of Patent: Jun. 19, 2018

(54) FIRE-FIGHTING WALL-CASING SYSTEM

(71) Applicant: Alessandro Palladino, Rome (IT)

(72) Inventor: Alessandro Palladino, Rome (IT)

( * ) Notice: Subject to any disclaimer, the term of this patent is extended or adjusted under 35 U.S.C. 154(b) by 0 days. days.

(21) Appl. No.: 15/320,322

(22) PCT Filed: Jun. 23, 2015

(86) PCT No.: PCT/IB2015/054703
§ 371 (c)(1),
(2) Date: Dec. 20, 2016

(87) PCT Pub. No.: WO2016/001794
PCT Pub. Date: Jan. 7, 2016

(65) Prior Publication Data

US 2017/0145683 A1 May 25, 2017

(30) Foreign Application Priority Data

Jun. 30, 2014 (IT) ..... RM2014A0340

(51) Int. Cl.

| | |
|---|---|
| ***E04B 1/346*** | (2006.01) |
| ***E04B 1/343*** | (2006.01) |
| ***A62B 3/00*** | (2006.01) |
| ***E04B 1/344*** | (2006.01) |

(52) U.S. Cl.
CPC ..... *E04B 1/34357* (2013.01); *A62B 3/00* (2013.01); *E04B 1/344* (2013.01)

(58) Field of Classification Search
CPC ..... E04B 2/828; E04B 2/827; E04B 1/34357; E04B 1/344; A62B 3/00; A62B 3/005; A62B 5/00
USPC ..... 52/243.1, 232, 64, 1; 49/27, 28, 1, 6, 8; 160/84.02, 181, 206
See application file for complete search history.

(56) References Cited

U.S. PATENT DOCUMENTS

| | | | | |
|---|---|---|---|---|
| 6,079,162 | A * | 6/2000 | Hein | E05F 15/72 49/1 |
| 6,748,700 | B1 | 6/2004 | McAllister | |
| 2005/0284035 | A1* | 12/2005 | DeOvando | E04B 1/3431 52/79.1 |
| 2009/0113799 | A1* | 5/2009 | Luttmann | E04B 2/827 49/127 |
| 2010/0139572 | A1* | 6/2010 | Sia | A01K 31/00 119/346 |

(Continued)

OTHER PUBLICATIONS

International Search Report, dated Mar. 29, 2016, from corresponding PCT application.

*Primary Examiner* — Chi Q Nguyen
(74) *Attorney, Agent, or Firm* — Young & Thompson

(57) ABSTRACT

Fire-fighting wall casing for closed environments, constituted of a frame (4) housing, in its upper portion, a soffit (3) which slides downwards by way of a system of pulleys placed within the frame (4), in its central portion a shutter (1) which may be opened by a side-hinge system, in its lower portion a railing (2) sliding upwards by way of a side guide (8) a protection grid (7) which, after being disconnected from the railing, may be removed by way of side retainers; a magnetic switch (6) and a smoke and/or seismic detector being positioned in its upper portion; a fume deflector (9), intended for extracting fumes from the upper floors, being positioned above the casing.

6 Claims, 4 Drawing Sheets

(a) (b)

(56) References Cited

U.S. PATENT DOCUMENTS

Figure 1:
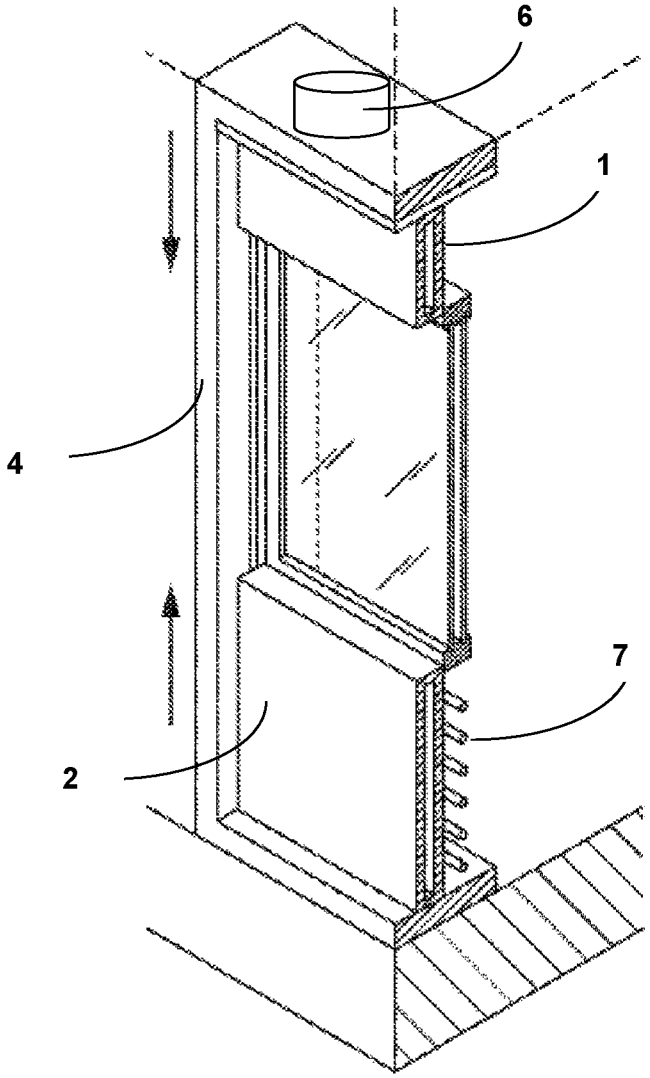
Figure 1:
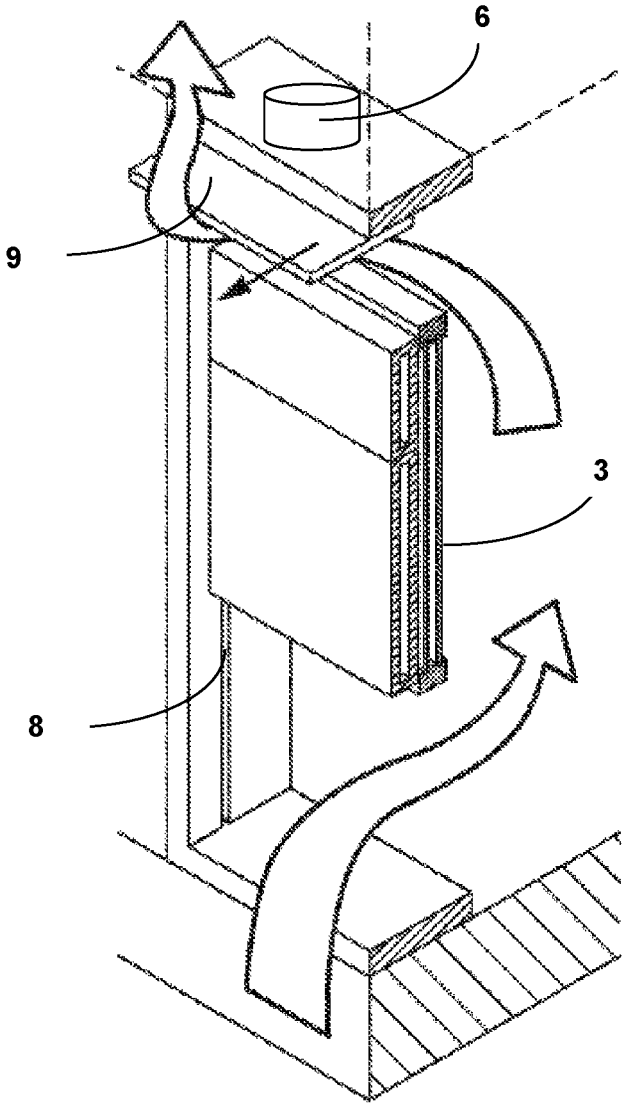

2011/0000625 A1* 1/2011 George ..... E06B 3/94
160/84.02

* cited by examiner (a)

(b)

(a)

FIRE-FIGHTING WALL-CASING SYSTEM

BACKGROUND OF THE INVENTION

Field of the Invention

This invention refers to a fire-fighting wall casing, i.e. a casing which, in the event of fire, allows to safely leave the location where the fire burst.

Description of the Related Art

Presently available fire-fighting systems are conceived so as to allow to take action during fire phases other than those considered herein and coped with by this invention. If action is taken soon after the fire burst, damage is limited, but if the exponential rapidity of growth is not curbed, a so-called flashover occurs causing, due to an increase in temperature from 600 to 1000° C., all the elements existing at the site to set on fire.

Investigations carried out personally in this sector have shown a deficiency of means appropriate to cope with the issues presently existing in matter of "safety" at homes and work places.

SUMMARY OF THE INVENTION

This invention may provide an advantage not only to those operating in the industrial sector, but also to those operating in the civil sector, because it is different from the presently existing products of the subject-matter sector which only provide for the natural extraction of fumes through the openings placed on workshops' roofing. This invention titled "fire-fighting wall-casing system", in addition to several advantages, allows rescuers and the individuals to be rescued to move from outdoor to indoor well before the well-known flashover occurs.

A fire-fighting wall casing for closed environments, constituted of a frame (4) housing, in an upper portion thereof, includes a soffit (3) which slides downwards by means of a system of pulleys (14) placed within the frame (4), in a central portion of the frame housing a shutter (1) which may be opened by a side-hinge system, in a lower portion of the frame housing a railing (2) sliding upwards by means of a side guide (8) a protection grid (7) which, after being disconnected from the railing, may be removed by means of side retainers; a magnetic switch (6) and a smoke and/or seismic detector being positioned in the upper portion; a fume deflector (9), intended for extracting fumes from the upper floors, being positioned above the casing.

The soffit and the railing are of a leaf type (12) with side hinges allowing them to open outwards. Alternately, the soffit and the railing are of a flap type (13) with lower-side hinges allowing them to open outwards.

A fire-fighting method is constituted of the following phases:

- following to an event, the triggering signal delivered by the fume or seismic detector to the magnetic switch (6) will operate the system by opening the volumes placed in the upper and lower portion of the casing;
- when the retainer (6) is released, the soffit (3) will slide by gravity along guide (8) downwards pulling the railing (2), the parallel movement of the two members (3) and (2) allowing, from the upper portion, the outlet of gas and fumes (2) caused to move away from the façade by means of the deflector (9) and the inlet, from the lower portion, of outdoor air.

- After the opening movement by sliding is completed, the protection grid (7) may be removed from either the inside or the outside by removing the side retainers preventing protection grid removal and providing, in case of failure, a protection against the fall from height.

Therefore, because of its peculiarity, it is addressed to a wide range of users constituted of hospitals, offices, schools, commercial activities, buildings used as dwellings or offices and, therefore, anywhere there is the need of preserving the safety of people and property.

BRIEF DESCRIPTION OF THE DRAWING FIGURES

FIGS. 1(*a*) and 1(*b*) show views of the fire-fighting wall casing system according to an embodiment of the present invention.

Figure 2:
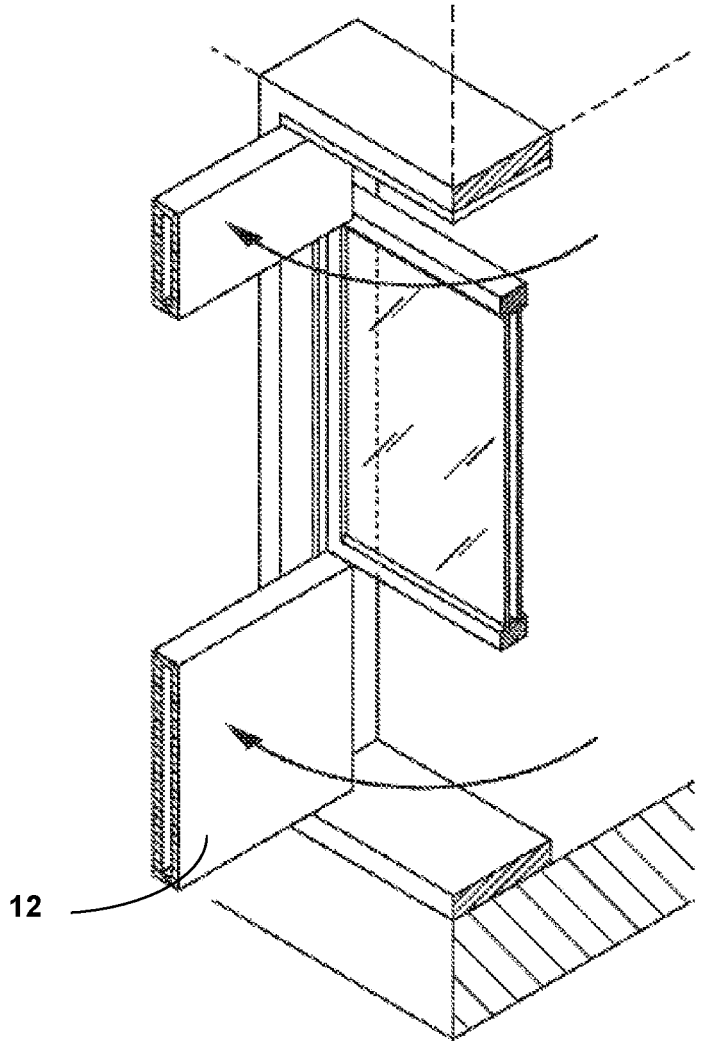
Figure 2:
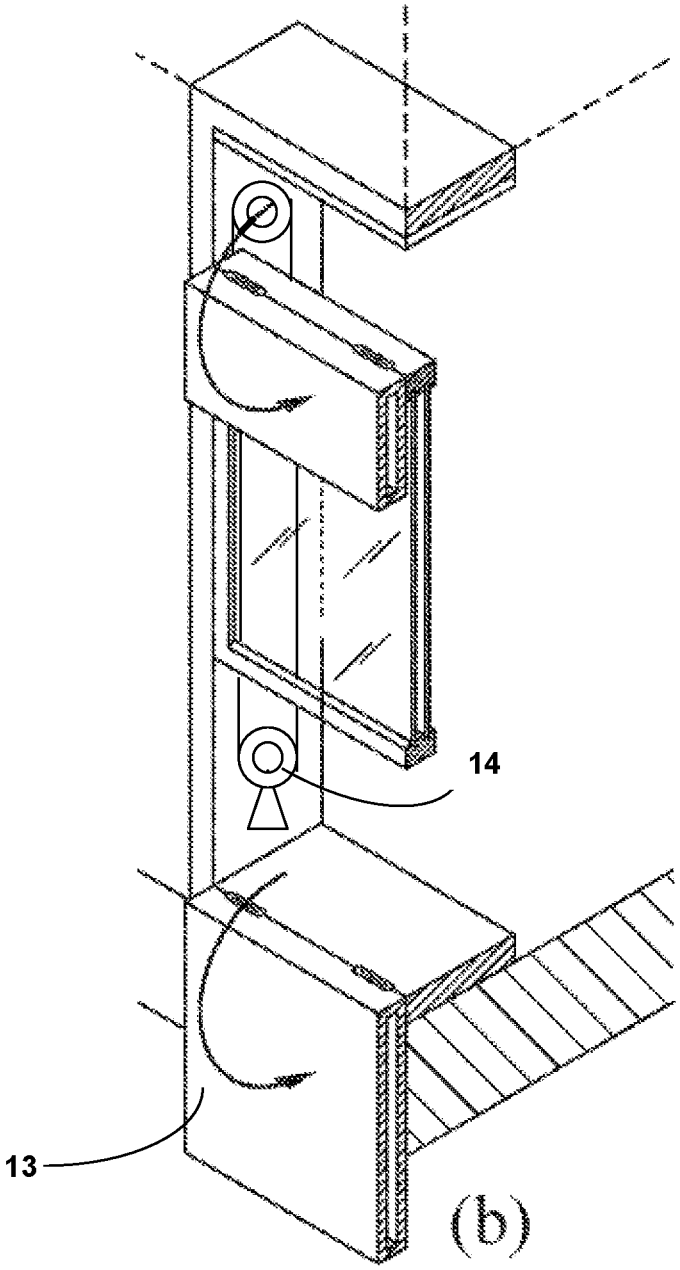

FIGS. 2(*a*) and 2(*b*) show views of the fire-fighting wall casing system according to another embodiment of the present invention.

DETAILED DESCRIPTION OF THE INVENTION

The Horizontal Technical Regulation, recently published by the Italian Ministry of Interior—National Fire Brigade Service, provides for the development of measures for the implementation of fire safety plans for all the activities controlled by the National Fire Brigade Service, by the adoption of "innovating solutions" which, however, due to their originality, are certified as effective by qualified Professionals.

A standardized production will allow to execute the measurements which are preliminary to the definition of the technical characteristics of the product, on the basis of which the risk may be assessed and, therefore, all certified in accordance with the law.

Combustion is an oxidation reaction occurring rapidly and generating heat.

Fire (i.e. the combustion process) results from the combination of three elements which are required to concurrently exist so that it may occur. In the event even only one of them is lacking, combustion can not occur.

They are:

1) The combustible substance, i.e. the material which is able to chemically combine with the oxidizing substance;

2) The oxidizing substance, usually oxygen, which supports combustion by oxidizing the combustible substance;

3) A source releasing an appropriate amount of thermal energy which is able to start the combustion process (achievement of the "ignition" temperature of the combustible substance);

Not only the maximum threshold temperature has to be assessed in order to determine the hazardousness and the characteristics of a fire, but also the velocity of the combustion process and the quantity of oxygen existing in the premises where it burst.

The development of a fire is usually divided into four phases:

- ignition;
- growth;
- flashover (fully developed fire);
- decay.

1) Ignition: the phase in which the combustion process starts.

2) Growth: The fire grows and, if in the proximity of some more combustible substances, the fire grows and the average temperature of premises is still relatively low.

3) Flashover (fully developed fire): The flashover is defined as the transition from a growing fire into a fully developed fire in which all the combustible materials existing in the concerned area, including those laying not in the proximity of flames, are simultaneously involved in the fire. During flashover, the following changes occur in the premises:

a) increase in combustion velocity;

b) high heat release with consequent sudden increase in temperature;

c) considerable increase in fumes and combustion gas, and sudden propagation of flames through unburnt gases and vapours collecting close to the ceiling.

4) Decay: the fire event starts slowing down due to exhaustion of the combustible substance and the extinguishment starts by a decrease in the heat generated.

Therefore, temperature starts decreasing.

In order to curb a fire event, it is necessary that action be taken at the time of first propagation, that is to say before the flashover, when temperature is still relatively low and fire has not affected the whole system, making it possible to extinguish the fire and curb damage, thereafter fire can no longer be curbed.

Flashover: the fire event is in its full development phase, temperature rises suddenly and reaches values which are sufficient to make combustion increase exponentially. Gas emissions and incandescent particles spread out horizontally, but above all vertically upwards, and form with air a flammable mixture which may be ignited by ambient temperature. During this phase, the flashover, lasting from 5 to 25 minutes, the nature of combustible substances and the percentage of available oxidizing substance, may cause temperature to increase up to 400-500° C.

The invention allows to take prompt action, therefore, prior to the formation of the flashover thus significantly reducing the seriousness of bodily damage and of damage to property.

This system may be used for "storey-by-storey" applications or in applications wherein it extends from the floor to beyond the floor of the upper floor.

The device, due to the possibility of being put in place in the façade and thanks to the timely opening of air inlets and outlets, will allow to extend the duration of the rescue activity, further facilitating rescue-team members' access and the possible transportation of people or property involved in the fire event to the outside.

By making a distinction between air inlets and outlets, the area devoted to the rescue activity will not be polluted with fumes and gas, thus enabling the operator to fulfil his/her activity thus curbing the damage caused to the operator himself/herself and to the rescued individual, if any, resulting from the inhalation of fumes and gas.

The prompt inflow of cold air will enable rescuers to see the situation of the places free from fumes and, therefore, immediately visible.

The design was implemented in compliance with the provisions governing the matter and the precautionary measures which the lawmaker intended to preserve and enact through the document UNI 9494-1 and 2 have been adopted. Moreover, the dimensioning of the premises evacuated in the event of operation of the device takes into account the most recent provisions governing the matter as set forth in the Fire Prevention Consolidated Text—edition of Apr. 12, 2014.

The system is constituted of a fume sensor located above the soffit, which measures temperature and when it reaches the value of 64° C. it operates an electromagnetic release device which is able to operate, by means of a pulley, a mechanism providing both the upper and lower panels of the wall-casing to slide. The device operation may also be triggered by a seismic detector in the event of earthquake. In the event the system is so triggered, both the upper and lower panels, to be placed in the area opposite to the casing, will be connected to a counterbalance through pulleys.

Therefore, the ports of the two volumes, corresponding to the two panels moved by sliding, will open through which cold air may flow inside, from the bottom, and gas and fumes together with hot air, which during fire propagation have collected at the top, may flow outside.

The opening of the ports, as described above, may take place not only by the convergent sliding of the upper and lower member, but also through a leaf-opening or vasistas opening system with a 180° outward rotation. Moreover, the lower opening, after removing the protection grid by means of two simple sliding retainers, intended for keeping objects or people from falling in the event of unintentional operation, will allow rescuers to promptly see the environment and an easier transportation of the people therein to the outside.

Last but not least, glass explosion will not occur because the indoor temperature will not reach 400° C.

After service, in the event no change has affected the structure, the system serviceability may be resumed, also autonomously, by simply repositioning the members to their original position.

The invention claimed is:

1. A fire-fighting wall casing for closed environments, comprising:

a frame housing;

a soffit in an upper portion of the frame housing, the soffit being configured to slide downwards by means of a system of pulleys placed within the frame housing;

a shutter in a central portion of the frame housing the shutter being opened by a side-hinge system;

a railing in a lower portion of the frame housing, the railing sliding upwards by means of a side guide;

a protection grid which, after being disconnected from the railing, is removable via side retainers;

at least one of a magnetic switch, a smoke detector or a seismic detector being positioned in the upper portion; and a fume deflector configured for extracting fumes from the upper floors, being positioned above the casing, wherein the fire-fighting wall casing has a lower air inlet and an upper air outlet.

2. The fire-fighting wall casing for closed environments according to claim 1, wherein the soffit and the railing are a leaf with side hinges allowing the leaf to open outwards.

3. A method of operation of the fire-fighting casing according to claim 2, comprising:

following an event, a triggering signal delivered by the fume or seismic detector to the magnetic switch will operate the system by opening volumes placed in the upper and lower portion of the casing;

wherein a retainer is being released, the soffit will slide by gravity along the guide downwards pulling the railing, parallel movement of two members allowing, from the upper portion, the outlet of gas and fumes caused to move away from the façade by action of the deflector and the inlet, from the lower portion, of outdoor air; and after an opening movement by sliding is completed, the protection grid is removed from either inside or outside by removing side retainers, preventing protection grid removal and providing, in case of failure, a protection against a fall from height.

4. The fire-fighting wall casing for closed environments according to claim 1, wherein the soffit and the railing are a flap with lower-side hinges allowing the flap to open outwards.

5. A method of operation of the fire-fighting casing according to claim 4, comprising:

following an event, a triggering signal delivered by the fume or seismic detector to the magnetic switch will operate the system by opening volumes placed in the upper and lower portion of the casing;

wherein a retainer is being released, the soffit will slide by gravity along the guide downwards pulling the railing, parallel movement of two members allowing, from the upper portion, the outlet of gas and fumes caused to move away from the façade by action of the deflector and the inlet, from the lower portion, of outdoor air; and after an opening movement by sliding is completed, the protection grid is removed from either inside or outside by removing side retainers, preventing protection grid removal and providing, in case of failure, a protection against a fall from height.

6. A method of operation of the fire-fighting casing according to claim 1, comprising:

following an event, a triggering signal delivered by the fume or seismic detector to the magnetic switch will operate the system by opening volumes placed in the upper and lower portion of the casing;

wherein a retainer is being released, the soffit will slide by gravity along the guide downwards pulling the railing, parallel movement of two members allowing, from the upper portion, the outlet of gas and fumes caused to move away from the façade by action of the deflector and the inlet, from the lower portion, of outdoor air; and after an opening movement by sliding is completed, the protection grid is removed from either inside or outside by removing side retainers, preventing protection grid removal and providing, in case of failure, a protection against a fall from height.

* * * * *